US006659919B2

(12) United States Patent
Deola

(10) Patent No.: US 6,659,919 B2
(45) Date of Patent: Dec. 9, 2003

(54) LEG EXERCISER

(76) Inventor: James A. Deola, 2584 S. Lincoln Ave., Vineland, NJ (US) 08361

( * ) Notice: Subject to any disclaimer, the term of this patent is extended or adjusted under 35 U.S.C. 154(b) by 314 days.

(21) Appl. No.: 09/892,710

(22) Filed: Jun. 27, 2001

(65) Prior Publication Data

US 2003/0171193 A1 Sep. 11, 2003

(51) Int. Cl.[7] ..... A63B 21/062
(52) U.S. Cl. ..... 482/99; 482/92; 482/137
(58) Field of Search ..... 482/137, 92, 100, 482/99, 138, 79, 102, 139, 103, 104, 94, 142, 130

(56) References Cited

U.S. PATENT DOCUMENTS 5,044,633 A * 9/1991 Rice
5,267,930 A 12/1993 Henes
5,358,462 A * 10/1994 Calderone
5,549,533 A * 8/1996 Olson et al.
5,616,111 A * 4/1997 Randolph
5,669,865 A 9/1997 Gordon
6,030,322 A 2/2000 Webber
6,319,178 B1 * 11/2001 Webber

* cited by examiner

*Primary Examiner*—Jerome W. Donnelly
(74) *Attorney, Agent, or Firm*—Norman E. Lehrer

(57) ABSTRACT

An exercising apparatus is disclosed which allows a user to perform a variety of leg exercises including leg extensions and leg presses. The exercise apparatus has a front and a back and includes a frame having an upper frame member and a lower base frame member. A seat is mounted to the upper frame member. The lower base frame member extends forwardly of the seat and the lower end of a press arm is pivotally secured to the forward end thereof. The press arm extends upwardly to the area in front of the seat and the upper end thereof is pivotable toward and away from the seat. A first resistance, biases the press arm toward the seat. A curl bar has an upper end pivotally secured to the upper end of said press arm such that the lower end of the curl bar is pivotable toward and away from the press arm and a curl pad is adjustably mounted adjacent the lower end of the curl bar. The curl pad is arranged so that a user sitting on the seat can position his feet under the curl pad with the curl pad engaging the upper part of the user's feet and the forward part of the user's ankles for performing leg extensions. When such leg extension exercises are being performed, a second resistance, biases the curl bar toward the press arm. A foot engaging pad or the like is also carried by the curl bar for engagement by the bottom of a user's feet for performing leg press exercises.

7 Claims, 3 Drawing Sheets

18
46
62
54
28
30
20
14
16
10
24
32
26
34
38
42
52

30
32
18
10
46
62
28
14
16
20
47
52
24
26
34
38
42

18
28
30
20
14
66
62
32
26
16
24
47
46
10
34
38
42

30
18
32
14
28
50
48
20
16
26
47
46
62
24
34
10
42
38

LEG EXERCISER

BACKGROUND OF THE INVENTION

The present invention is directed toward an exercising apparatus and more particularly toward a leg exerciser which allows a user to perform a variety of exercises including leg extensions and leg presses.

While it has always been recognized that exercising of the lower body and particularly the legs is desirable, it has also been problematic. Although walking, jogging and running may provide substantial aerobic benefits to the body, they are not particularly useful exercises for strength conditioning. Such exercises are also not useful for a number of specific muscle groups in the lower body.

Exercise machines commonly referred to as weight machines have been designed which allow a user to exercise specific lower body muscle groups. These exercise machines frequently include a weight stack mounted for vertical movement which is linked to various exercise stations by way of a linkage system such as cables and pulley mechanisms. Moveable portions of the exercise machine are then engaged by the user and these mechanism isolate the motion and loading of a specific muscle group.

As is well known in the art, the resistance, range and angle of motion required to exercise one muscle group are frequently very much different than those required to exercise a different muscle group. For example, the type of motion and the amount of resistance required to perform leg extensions is very different from the type of motion and amount of resistance required for performing leg presses. As a result, the exercise equipment needed to perform leg extensions differs significantly from the type of equipment required to perform leg presses.

Because the type of exercise equipment required to perform different lower body leg exercises differs significantly, a person wishing to perform both types of exercises must employ two different pieces of equipment. Alternatively, a single multi-exercise apparatus could be designed that simply incorporates sufficient equipment to allow several types of lower body exercises to be performed. Such equipment, however, would tend to be relatively large and cumbersome. While this would normally not create a problem in a commercial setting such as a public gym or the like, such equipment would not be useful to the average person wishing to exercise at home.

Undoubtedly, attempts have been made to consolidate different types of equipment into a single multi-exercise apparatus which is compact so as to be useful in a home. Most such machines, however, require substantial rearrangement or reconfiguration of the various parts by the user. To applicant's knowledge, any proposed machine that does not require extensive reconfiguration does not provide the appropriate motion or range of motion for properly performing the desired exercises.

SUMMARY OF THE INVENTION

The present invention is designed to overcome the deficiencies of the prior art described above. The exercise apparatus of the invention is compact and allows a user to perform a variety of leg exercises including leg extensions and leg presses. Although the invention could be attached to substantially any piece of exercise apparatus, in its preferred form it includes a frame having an upper frame member and a lower base frame member. A seat is mounted to the upper frame member and is arranged to permit a user to sit thereon while facing forwardly. The lower base frame member extends forwardly of the seat and the lower end of a press arm is pivotally secured to the forward end thereof. The press arm extends upwardly to the area in front of the seat and the upper end thereof is pivotable toward and away from the seat. A first resistance, which may be a part of a conventional weight stack and cable system, biases the press arm toward the seat. A curl bar has an upper end pivotally secured to the upper end of said press arm such that the lower end of the curl bar is pivotable toward and away from the press arm and a curl pad is adjustably mounted adjacent the lower end of the curl bar. The curl pad is arranged so that a user sitting on the seat can position his feet under the curl pad with the curl pad engaging the upper part of the user's feet and the forward part of the user's ankles for performing leg extensions. When such leg extension exercises are being performed, a second resistance, which may also be a part of a conventional weight stack and cable system, biases the curl bar toward the press arm. A foot engaging pad or the like is also carried by the curl bar for engagement by the bottom of a user's feet for performing leg press exercises.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figure 1:
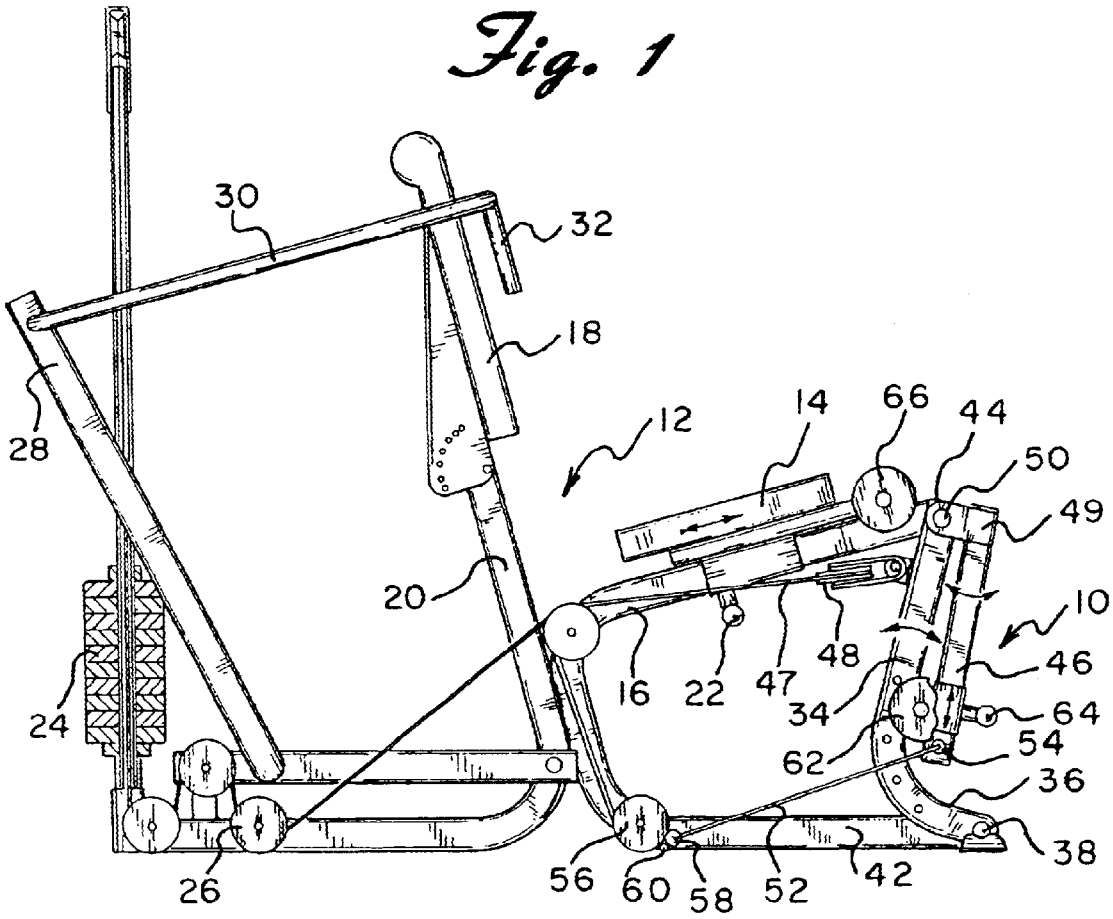
FIG. 1 is a side elevational view of a leg exerciser constructed in accordance with the principles of the present invention and incorporated into an exercise machine.

Referring now to the drawings in detail wherein like reference numerals have been used in both of the figures to designate like elements, there is shown in each of the figures a leg exerciser constructed in accordance with the principles of the present invention and designated generally as 10. The leg exerciser 10 is shown in combination with a weight machine 12. This is, however, by way of example only as various other types of weight machines could also be employed with the present invention. Furthermore, the leg exerciser of the present invention could be used with a much simpler exercising apparatus as will be explained more fully hereinafter.

In any event, the exercising machine 12 includes a seat including a seat bottom 14 mounted on an upper frame member 16 and a seat back 18 mounted on a frame member 20. The seat bottom 14 is preferably mounted so as to be slidably moveable forwardly i.e. to the right as shown in FIG. 1, or rearwardly i.e. to the left as shown in FIG. 1, in order to accommodate the user of the apparatus in performing various different exercises. Movement of the seat bottom 14 is accomplished by pulling the spring loaded stop pin 22 out, sliding the seat bottom 14 backwardly or forwardly and reinserting the pin 18 in the known manner.

Figure 2:
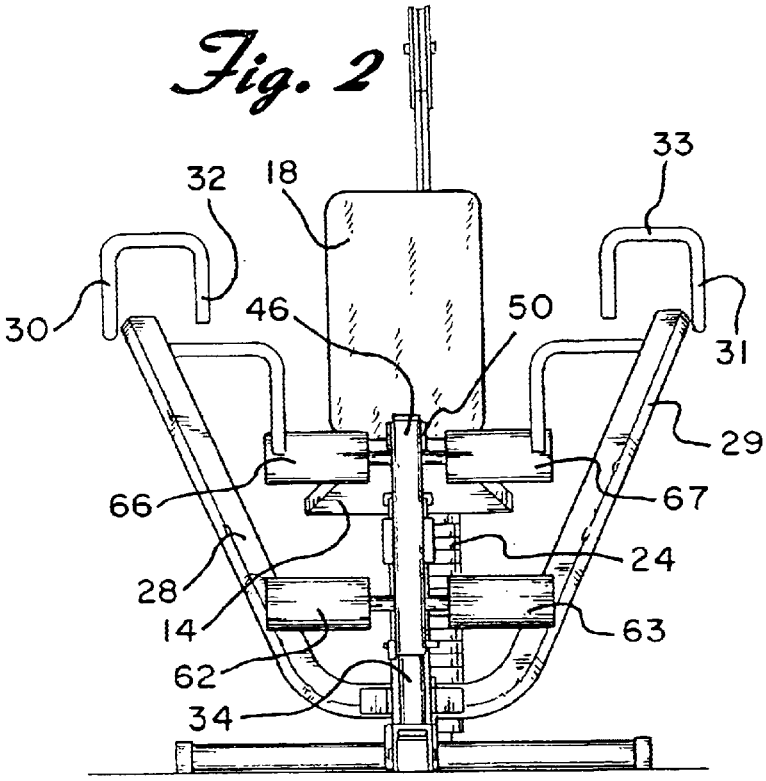
FIG. 2 is a front elevational view of the exercise machine of FIG. 1.

The exercise machine 12 also includes a weight stack 24 which is linked to various parts of the equipment through a plurality of cables and pulley mechanisms such as shown at 26 to enable the user to exercise various different muscle groups. Even further, the exercise machine 12 illustrated in the figures includes a pair of levers 28 and 29 having their lower ends pivoted to a base member and including a pair of arms 30 and 31 that extend forwardly at either side of the apparatus terminating in hand grips 32 and 33. (See FIG. 2.)

The foregoing apparatus thus described is, per se, well known in the art. Similar machines have been known for some time and are shown and described, for example, in prior U.S. Pat. Nos. Des. 359,326 and 6,030,322. Since the apparatus is, per se, well known, it is not believed that a detailed description of the operation of the component parts thereof is necessary.

The present invention is primarily concerned with the leg exerciser 10 which is mounted to the front end of the exercise apparatus 12 (the right side as viewed in FIG. 1). The leg exerciser 10 is comprised essentially of a press arm 34 having its arcuately shaped or bent lower end 36 pivotally secured through pivot 38 to the forwardmost end 40 of the base frame member 42 of the exercise machine 12.

The forward end 40 of the base frame member 42 extends forwardly of the seat bottom 14. The press arm 34 then extends upwardly so that the top or upper end 34 thereof lies in front of the seat 14. As shown most clearly in FIGS. 5 and 6, this arrangement allows the upper end 44 of the press arm 34 to be pivotally moveable toward and away from the seat 14 about the pivot point 38. A first resistance means in the form of cable 47 which passes around pulley 48 biases the top 44 of the press arm 34 toward the seat 14. The cable 47 forms part of the cable and pulley system 26 discussed above and the amount of force needed to move the press arm 38 outwardly and which biases the same inwardly is determined by the amount of weight selected from the weight stack 24.

A curl bar 46 has its upper end 49 pivotally secured to the upper end 44 of the press arm 34 through the use of a pivot member 50. As a result, the lower end of the curl bar 46 is pivotally moveable toward and away from the press arm 34. A second resistance means in the form of a cable 52 biases the curl bar 46 toward the press arm 34. The free end of the cable 52 is secured to the lower end of the curl bar 46 at point 54. The cable 52 then passes over the pulley 56 and is connected to the cable 47 forming part of the first resistance means discussed above.

Preferably, the free end of the cable 52 is provided with a quick release type of connector so that it can be selectively attached to or removed from the point 54 at the lower end of the curl bar 46 whenever desired. A ball 58 is secured to the cable 52 which, when engaged by the stop member 60 prevents the cable 52 from passing rearwardly around the pulley 56. Thus, when the free end of the cable 52 is disconnected at point 54 from the curl bar 46, the end of the cable will simply lie on the ground and will not be drawn backwardly around the pulley 56.

Connected to either side of the centrally located curl bar 46 adjacent the lower end thereof are a pair of substantially cylindrically shaped curl pads 62 and 63. (See FIG. 2.) As shown best in FIG. 3, the curl pads are arranged so that a user sitting on the seat 14 can position his feet under the curl pads with the curl pad engaged in the upper part of the user's feet and the forward part of the user's ankles for performing leg extension exercises in a manner well known in the art. The position of the curl pads 62 and 63 along the length of the curl bar 46 can be adjusted by disengaging the pin 64 which, through an appropriate bracket, secures the curl pads 62 and 63 to the curl bar 46 in a manner well known in the art.

Figure 3:
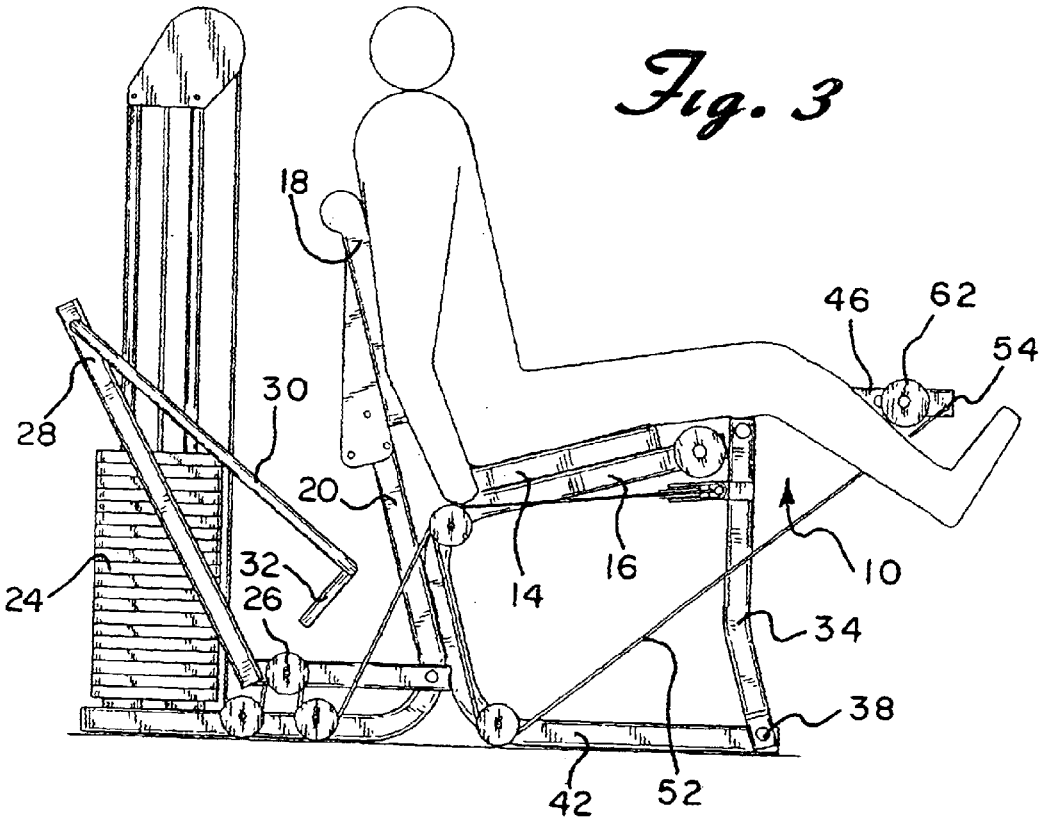
FIG. 3 is a side elevational view similar to FIG. 1 showing the leg exerciser being used to perform leg extensions.
Figure 5:
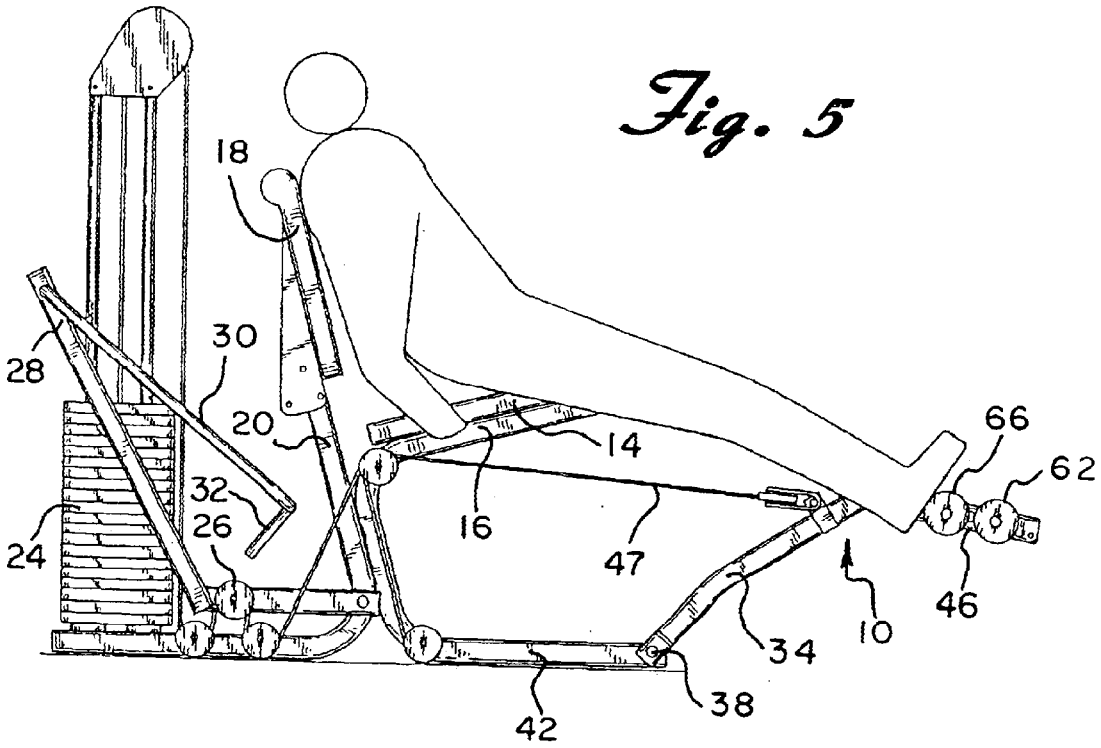
FIG. 5 is a view similar to FIG. 1 showing the leg exerciser being used to perform leg presses.

A second pair of cylindrically shaped pads 66 and 67 are secured to the upper frame member 16 forward of the seat bottom 14. They are, however, removable from the frame member 16 and can be secured to the curl bar 46 above the curl pads 62 and 63 as shown in FIG. 5. When the pads 66 and 67 are mounted on the frame 16, they are intended to support the lower portion of the user's thighs just above the knees when performing leg extensions as shown in FIG. 3. When the user wishes to perform leg press exercises, the pads 66 and 67 are removed from the frame 16 so as not to interfere with the user's body and are connected to the curl bar 46 so as to engage the bottom of the user's feet as shown in FIG. 5. Alternatively, the curl pads 62 and 63 can be used in lieu of the pads 66 and 67 to engage the bottom of the user's feet when performing various types of leg exercises.

Figure 4:
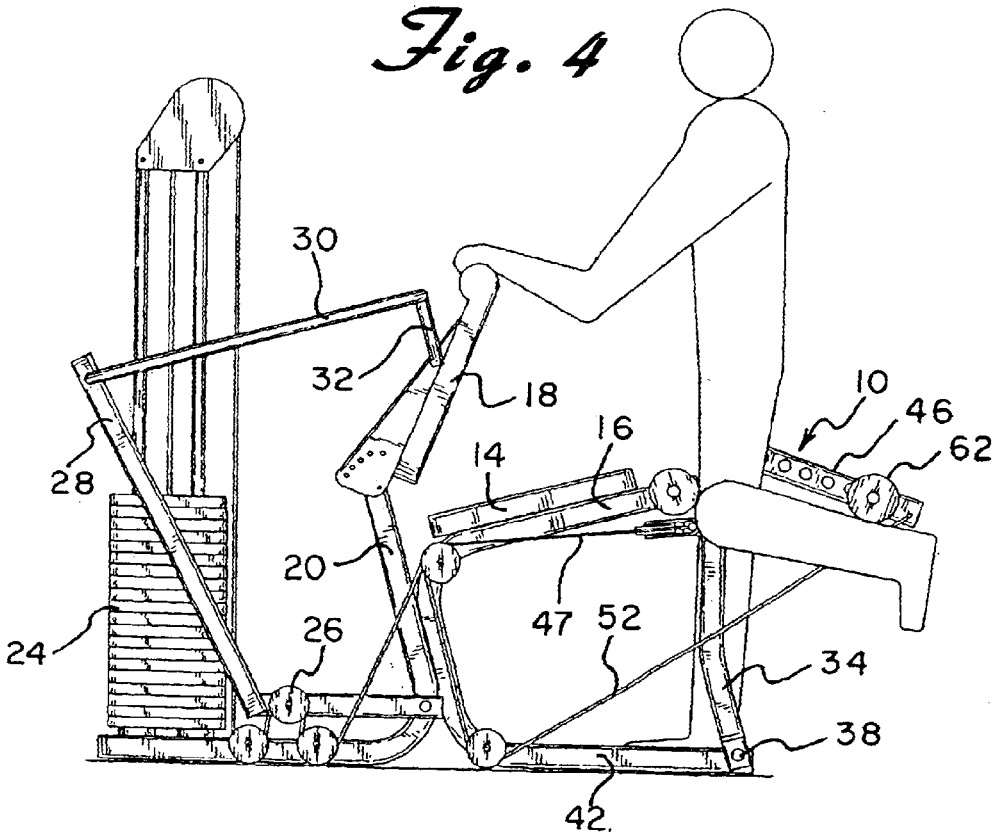
FIG. 4 is a view similar to FIG. 1 showing the leg exerciser being used to perform leg curls.
Figure 6:
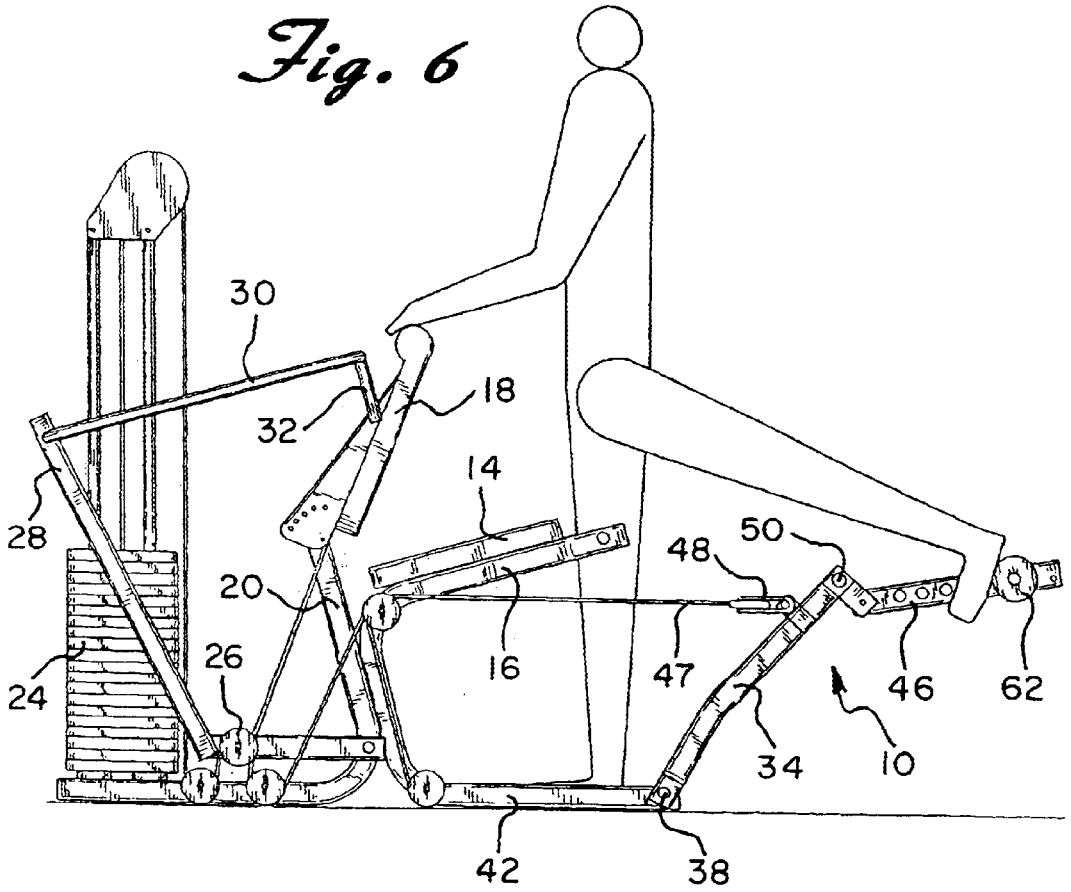
FIG. 6 is a view similar to FIG. 1 showing the leg exerciser being used to perform butt toner exercises.

The manner in which the leg exerciser 10 of the present invention is utilized to perform various types of leg exercises is clearly shown in FIGS. 3–6. With the cable 52 attached to the lower end of the curl bar 46, leg extensions can be performed in a conventional manner as can other types of leg exercises such as leg curls as shown in FIG. 4. The position of the seat 14 and of the curl pads 62 and 63 can, of course, be adjusted to suit the user as will the amount of weight selected from weight stack 24. When it is desired to perform leg presses and similar exercises as shown in FIGS. 5 and 6, the cable 52 is disconnected from the lower end of the curl bar 46 so that the curl bar 46 pivots freely about pivot point 54. The proper amount of resistance is then provided by the cable 47 which passes around the pulley 48 which, in turn, is connected to the weight stack 24. As shown best in FIGS. 4 and 6, when the user is standing and facing rearwardly to perform various types of leg exercises, the seat back 18 can be pivoted forwardly so as to be grasped by the user's hands for balance or support.

The present invention may be embodied in other specific forms without departing from the spirit or essential attributes thereof and accordingly, reference should be made to the appended claims rather than to the foregoing specification as indicating the scope of the invention.

I claim:

1. An exercising apparatus which allows a user to perform a variety of leg exercises including leg extensions and leg presses, said apparatus having a front and a back and comprising:

a frame, said frame including an upper frame member and a lower base frame member;

a seat mounted to said upper frame member, said seat permitting a user to sit thereon while facing forwardly;

said lower base frame member extending forwardly of said seat;

a press arm pivotally secured to the forward end of said base frame member and extending upwardly to the area in front of said seat, the upper end of said press arm being pivotable toward and away from said seat;

first resistance means biasing said press arm toward said seat;

a curl bar having an upper end pivotally secured to the upper end of said press arm such that the lower end of said curl bar is pivotable toward and away from said press arm;

a curl pad mounted adjacent the lower end of said curl bar and being arranged so that a user sitting on said seat can position his feet under the curl pad with the curl pad engaging the upper part of the user's feet and the forward part of the user's ankles for performing leg extensions, and second resistance means biasing said curl bar toward said press arm.

2. The exercising apparatus as claimed in claim 1 including means carried by said curl bar that can be engaged by the bottom of a user's feet for performing leg press exercises.

3. The exercising apparatus as claimed in claim 1 including means for removing said second resistance means from said curl bar.

4. The exercising apparatus as claimed in claim 1 including means for adjusting the position of said curl pad along the length of said curl bar.

5. The exercising apparatus as claimed in claim 1 including means for adjusting the position of said seat.

6. The exercising apparatus as claimed in claim 1 wherein said first resistance means includes a first pulley carried by said press arm and a cable passing around said pulley.

7. The exercising apparatus as claimed in claim 6 wherein said second resistance means includes a second pulley carried by said lower base frame member and wherein said cable passes around said second pulley after it passes around said first pulley and has its free end removably secured to said curl bar.

* * * * *